US006223956B1

(12) United States Patent
Albers

(10) Patent No.: US 6,223,956 B1
(45) Date of Patent: May 1, 2001

(54) SELF-CLOSING VALVE ASSEMBLY FOR A DISPENSING OPENING OF A CONTAINER

(75) Inventor: Martin Albers, Sundern (DE)

(73) Assignee: Georg Menshen GmbH & Co. KG, Finnentrop (DE)

( * ) Notice: Subject to any disclaimer, the term of this patent is extended or adjusted under 35 U.S.C. 154(b) by 0 days.

(21) Appl. No.: 09/576,142

(22) Filed: May 22, 2000

Related U.S. Application Data

(63) Continuation of application No. PCT/EP99/06870, filed on Sep. 16, 1999.

(30) Foreign Application Priority Data

Oct. 1, 1998 (DE) ..... 298 17 571 U

(51) Int. Cl.[7] ..... B65D 25/40
(52) U.S. Cl. ..... 222/494; 137/493
(58) Field of Search ..... 222/490, 494, 222/213; 137/493.8, 493

(56) References Cited

U.S. PATENT DOCUMENTS 3,360,169 * 12/1967 Susuki et al. ..... 222/482
4,747,518 * 5/1988 Laauwe ..... 222/153
4,785,978 * 11/1988 Kano et al. ..... 222/482
5,115,950 * 5/1992 Rohr ..... 222/490

FOREIGN PATENT DOCUMENTS 195 10 007 10/1995 (DE) .
196 13 130 3/1997 (DE) .
939990 2/1997 (JP) .

* cited by examiner

*Primary Examiner*—Joseph A. Kaufman
*Assistant Examiner*—Melvin A. Cartagena
(74) *Attorney, Agent, or Firm*—Birch, Stewart, Kolasch & Birch, LLP

(57) ABSTRACT

A self-closing valve assembly for installation in a dispensing opening of a container, a seal cap or the like, includes a first closure element having a domed wall portion of resilient material incorporating a passage-opening, said wall portion being resiliently deformable from a closed position into an open position under the influence of a first differential pressure force resulting from pressures acting on its opposite surfaces, and a second closure element having a domed wall portion for sealing the passage-opening when the first closure element is in its closed position. In order to balance the pressure prvailing in a container provided with the valve assembly when a pressure-increasing squeezing force is no longer exerted on the container, the second closure element is adapted to be brought out of its sealing relationship with the passage-opening in the first closure element under the influence of a second differential pressure force resulting from pressures acting on its opposite surfaces, said second differential pressure force being directed oppositely to said first differential pressure force.

4 Claims, 1 Drawing Sheet

SELF-CLOSING VALVE ASSEMBLY FOR A DISPENSING OPENING OF A CONTAINER

This application is a Continuation of PCT International Application No. PCT/EP99/06870 filed on Sep. 16, 1999, which designated the United States, and on which priority is claimed under 35 U.S.C. § 120, the entire contents of which are hereby incorporated by reference.

BACKGROUND OF THE INVENTION

1. Field of the invention

The invention relates to a self-closing valve assembly for installation in a dispensing opening of a container, a seal cap or the like.

2. Description of the Related Art

A valve assembly of the present type, integrated into a seal cap, is known from DE-A-195 10 007. Therein, a membrane-like closure element of flexible material having a central, permanently open passage-opening is clamped between parts of the seal cap adapted to be screwed onto the neck of a container. In the inoperative state, the closure element is concavely curved and its outer face rests on a sealing element which is held stationary in the cap part in order to seal the passage-opening. The closure element can be lifted off the sealing element by an increased pressure exerted on the closure element applied from the side thereof facing the sealing element so that a medium can flow out along the passage-opening from a container, upon whose neck the seal cap can be screwed. As soon as the pressure force on the closure element is removed, the latter readopts its inoperative position due to the elasticity of the flexible material and thereby seals the passage-opening. On the other hand, the closure element is clamped in the cap part such that the tensional effect enables the entry of air, when a low pressure prevails in the interior of the container, in order to effect pressure balance. The pressure balancing function is thus dependent on how the closure element is clamped in the cap part and may be adversely affected by the elasticity of the closure element and the clamping forces effective thereon, so that the pressure balancing function cannot always be guaranteed. Moreover, the channels, along which the ventilating air can flow for producing the pressure balancing effect, can readily be blocked in use and the pressure balancing function may thereby be lost. It is also disadvantageous that the sealing of the passage-opening in the closure element is effected by means of a rigid, flat sealing element so that the sealing function can easily be adversely affected by deposits or dirt on the sealing surface.

An object of the invention is to provide a self-closing valve assembly of a type referred to above having improved sealing and pressure balancing functions. Another object of the invention is to provide a self-closing valve assembly of a type referred to above which can be more conveniently manufactured than prior self-closing valve assemblies. Still another object of the invention is to provide a self-closing valve assembly of a type referred to above which readily can be miniaturized.

SUMMARY OF THE INVENTION

The above and other objects of the inevntion will become apparent hereinafter and are achieved by a self-closing valve assembly for installation in a dispensing opening of a container, a seal cap or the like, which includes a first closure element having a wall portion of resilient material incorporating a passage-opening, said wall portion being resiliently deformable from a closed position into an open position under the influence of a first differential pressure force resulting from pressures acting on its opposite surfaces, and a second closure element for sealing the passage-opening when the first closure element is in its closed position. The second closure element can be brought out of its sealing relationship with the passage-opening of the first closure element under the influence of a second differential pressure force resulting from pressures acting on its opposite surfaces, said second differential pressure force being directed oppositely to said first differential pressure force. Accordingly, instead of a rigid second closure element, the valve assembly according to the invention includes a closure element which can yield resiliently, in the same manner as the first closure element, under the effect of an external differential pressure force acting thereon, and can thereby be brought off its sealing relationship with the passage-opening in the first closure element in order to allow ventilating air to flow into the interior of the container from the environment for the purposes of balancing the pressure prevailing in the container. Both the first and the second closure elements may comprise membrane-like domed wall portions and may be formed of suitable plastic materials having resilient properties e.g. an elastomeric material. Mounting of the closure elements so as to form a self-closing valve assembly does not cause any problems since the pressure balancing function is not adversely affected by a clamping force for mounting the closure elements. Furthermore, the valve assembly in accordance with the invention can easily be miniaturised, and, instead of being inserted into seal caps adapted to be screwed onto the neck of a container, it could also be inserted directly into a dispensing opening of a container.

For a more complete understanding of the invention and the objects thereof, reference should be made to the accompanying drawing and the following detailed description wherein a preferred embodiment of the invention is illustrated and described.

DESCRIPTION OF THE PREFFERED EMBODIMENT

Figure 1:
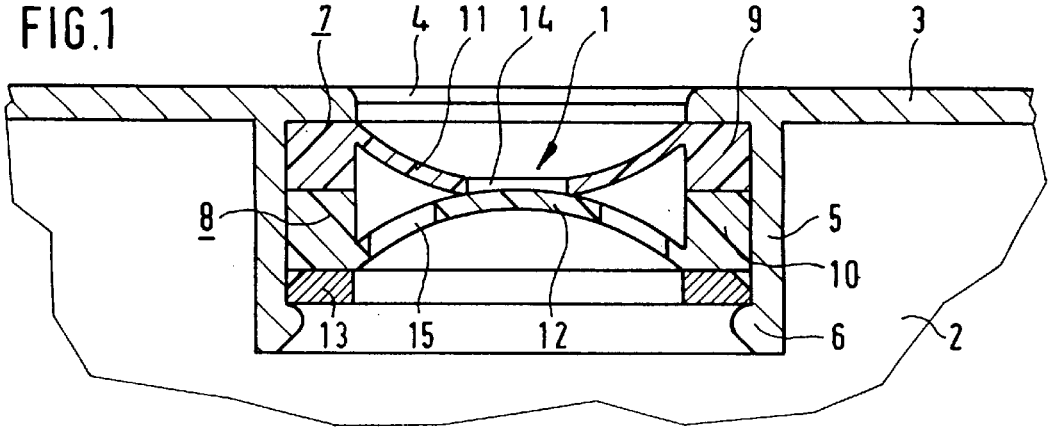
FIG. 1 shows in a fragmentary, sectional view a self-closing valve assembly in accordance with the invention, in the inoperative state, mounted in a dispensing opening of a container.

In FIG. 1, the self-closing valve assembly of the invention has the general reference 1 and is shown in a wall 3 of a container 2 or a seal cap or the like incorporating a dispensing opening 4. Although other means may be provided for mounting the valve assembly 1, in the present embodiment, a snap flange 5 having a latching collar 6 at its free end is formed on the container wall 3, concentrically of the dispensing opening 4. A plurality of circumferentially distributed latching webs could also be provided instead of a snap flange.

The valve assembly 1 mounted by a clamping force between the lower face of the wall 3 and the latching collar 6 comprises a first closure element 7, a second closure element 8 and a support ring 13 resting on the latching collar 6. Each closure element 7, 8 comprises respective outer, thickened, annular mounting portions 9, 10 and inner membrane-like wall portions 11, 12 integrally formed on the former In the inoperative state, the membrane-like wall portions 11, 12 have dome shaped configurations facing towards each other, as shown in FIG. 1.

A passage-opening 14 is provided in the membrane-like wall portion 11 of the first closure element 7 facing the dispensing opening 4. One or more passage-openings 15 in the membrane-like wall portion 12 of the second closure element 8 provide a fluid communication between the upper and lower faces of the membrane-like wall portion 12 at a position radially displaced from a central area of the wall portion 12. The central area of the wall portion 12 is free of perforations and is therefore capable, in the inoperative position shown in FIG. 1, of sealing the central passage-opening 14 of the first closure element 7 when the summits of the domed wall portions 11, 12 are disposed towards one another under the influence of a suitable bias force.

The closure elements 7, 8 may be made of a suitable resilient plastics material which allows them to be conveniently produced with the configuration desired by means of an injection moulding process. Elastomeric materials are particularly suitable materials. The closure elements 7, 8 may consist of a same or a differing material in order to obtain similar or differing resilient properties for these elements.

Figure 2:
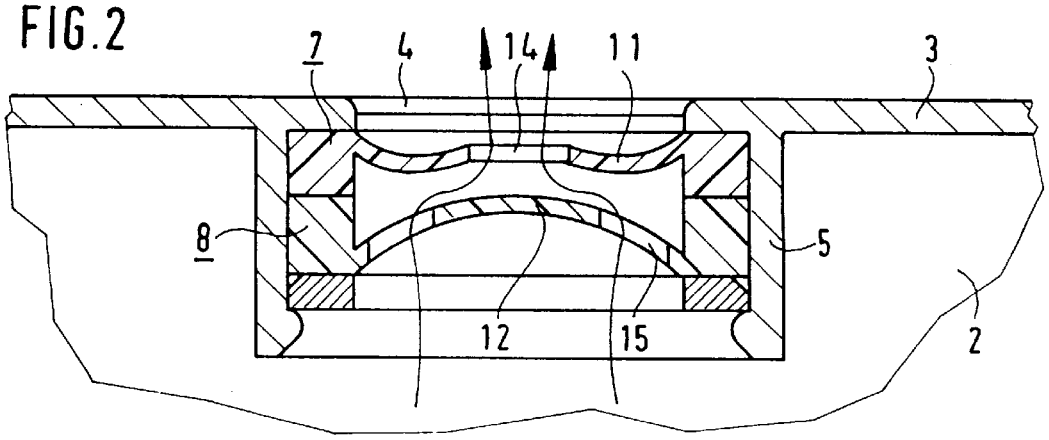
FIG. 2 shows in a similar view to FIG. 1 the valve assembly in its open position for dispensing the content of the container.
Figure 3:
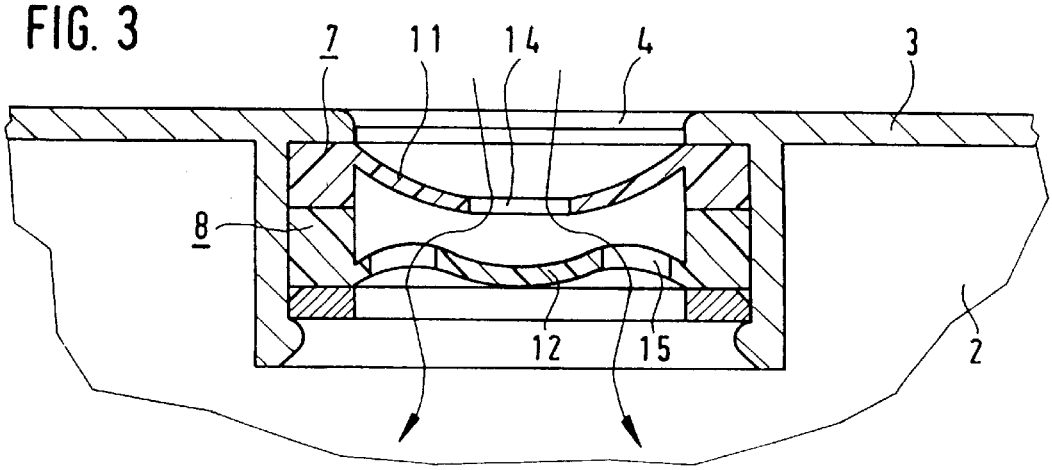
FIG. 3 shows in a similar view to FIG. 1 the valve assembly in its pressure balancing position.

The functioning of the self-closing valve assembly having a structure as previously described will be explained hereinafter with reference to FIGS. 2 and 3. FIG. 2 shows the state of the valve assembly as occurs when a differential pressure force acts on the first closure element 7 from below, the effect of this being that the wall portion 11 rises up from the wall portion 12 of the second closure element 8 thereby unblocking the passage-opening 14. This state can be produced by creating an overpressure in the container by squeezing the wall thereof. As soon as the overpressure falls off, the wall portion 11 of the first closure element 7 reverts to the starting position shown in FIG. 1 by virtue of its elasticity, thereby again sealing the passage-opening 14. The wall portion 12 of the second closure element 8 does not experience a change in shape when there is an overpressure in the container since this overpressure promotes the domed configuration of the wall portion 12.

The restoration of the container wall following a removal of the squeezing force may result in a negative pressure condition in the container which would prevent complete restoration to the original configuration if a pressure balance between the interior of the container and the environment could not take place. The position which the parts of the valve assembly 1 adopt in order to obtain a pressure balance is shown in FIG. 3. When negative pressure conditions exist in the container, a differential pressure force acts on the wall portion 12 of the second closure element 8 which results in the wall portion 12 deforming away from the passage-opening 14 in the first closure element 7 so that the passage-opening 14 becomes unblocked again. Consequently, air can flow from the outer environment through the passage-openings 14 and 15 in the wall portions 11, 12 of the closure elements 7, 8 into the interior of the container until a pressure balance occurs, thereby removing a load on the wall portion 12 which can then spring back into the starting position shown in FIG. 1 due to its elastic properties and thereby seal the passage-opening 14.

The invention has been described above on the basis of an embodiment comprising membrane-like domed wall portions of the closure elements. However, the invention is not restricted thereto. In particular, instead of a domed wall portion for the second closure element, a central sealing element which is axially moveable under the influence of forces acting thereon could be provided for sealing the passage-opening in the first closure element. This sealing element may be connected by e.g. spoke-like struts to the outer, thickened mounting portion of the second closure element. The support ring on which the closure elements are supported above one another is not obligatory and consequently, may be omitted if so desired. In this case, the thickened mounting portion of the second closure element would then be able to be supported directly on a ring collar or a similar part of the container.

What is claimed is:

1. A self-closing valve assembly for installation in a dispensing opening of a container or in a seal cap, including a first closure element having a wall portion of resilient material incorporating a passage-opening, said wall portion being resiliently deformable from a closed position into an open position under the influence of a first differential pressure force resulting from pressures acting on the opposite surfaces of said wall portion, and a second closure element for sealing the passage-opening when the first closure element is in its closed position, wherein said second closure element can be brought out of its sealing relationship with the passage-opening in the first closure element under the influence of a second pressure force resulting from pressures acting on its opposite surfaces, said second differential pressure force being directed oppositely to said first differential pressure force, and wherein the wall portions of the first and second closure elements have domed configurations directed towards each other in a balanced state of the loads acting thereon.

2. A valve assembly according to claim 1, wherein said second closure element comprises a wall portion of resilient material having at least one passage-opening displaced in a non-overlapping manner relative to the passage-opening in the first closure element.

3. A valve assembly according to claim 1, wherein both closure elements are of an elastomeric material.

4. A valve assembly according to claim 1 wherein in the closed position of the first closure element when the second closure element seals the passage-opening of the first closure element, a surface portion of the second closure element sealingly engages from below the passage-opening against the first closure element.

* * * * *